US009622571B1

(12) United States Patent
Wassel et al.

(10) Patent No.: US 9,622,571 B1
(45) Date of Patent: Apr. 18, 2017

(54) COLLAPSIBLE OUTDOOR TABLE

(71) Applicants: Edward J Wassel, Keller, TX (US); Mary A Sackleh, Trophy Club, TX (US)

(72) Inventors: Edward J Wassel, Keller, TX (US); Mary A Sackleh, Trophy Club, TX (US)

( * ) Notice: Subject to any disclaimer, the term of this patent is extended or adjusted under 35 U.S.C. 154(b) by 0 days.

(21) Appl. No.: 15/051,811

(22) Filed: Feb. 24, 2016

Related U.S. Application Data

(60) Provisional application No. 62/120,575, filed on Feb. 25, 2015.

(51) Int. Cl.

| | |
|---|---|
| ***A47B 85/00*** | (2006.01) |
| ***A47B 13/16*** | (2006.01) |
| ***A47B 37/04*** | (2006.01) |
| ***A47B 13/10*** | (2006.01) |
| ***A47B 3/00*** | (2006.01) |
| ***A47B 13/02*** | (2006.01) |

(52) U.S. Cl.
CPC ..... *A47B 13/16* (2013.01); *A47B 3/002* (2013.01); *A47B 13/023* (2013.01); *A47B 13/10* (2013.01); *A47B 37/04* (2013.01); *A47B 2013/025* (2013.01)

(58) Field of Classification Search
CPC ..... A47B 13/16; A47B 13/023; A47B 13/10; A47B 3/002; A47B 37/04; A47B 2013/025
USPC ..... 108/25, 26, 150, 44, 115; 248/188, 248/188.1, 188.6, 188.7, 188.9
See application file for complete search history.

(56) References Cited

U.S. PATENT DOCUMENTS 1,183,645 A * 5/1916 Hubbard ..... A47B 3/12 108/158
1,907,226 A * 5/1933 Von Nessen ..... A24F 19/0071 108/25
2,419,299 A * 4/1947 Tanner ..... A01J 25/004 108/44
2,791,477 A * 5/1957 Wesbecher ..... A47B 3/0803 108/11
2,803,419 A 8/1957 Phillips
2,838,351 A * 6/1958 Siconolfi ..... A47B 37/04 108/25
3,103,899 A * 9/1963 Macken ..... A47B 13/023 108/139
3,244,128 A * 4/1966 Rogalski ..... A47B 3/12 108/158.11
3,312,438 A * 4/1967 Goetz ..... A47B 3/12 248/165
3,366,079 A * 1/1968 Koransky ..... A47B 3/12 108/118

(Continued)

*Primary Examiner* — Jose V Chen
(74) *Attorney, Agent, or Firm* — Kenneth L Tolar

(57) ABSTRACT

A collapsible outdoor table includes a substantially triangular tabletop having a centrally positioned, circular indention on an upper surface for retaining a plate. Surrounding the central indention are a plurality of cylindrical cavities for holding a beverage container and a recessed area for storing accessory items. The tabletop is elevated above underlying terrain by a collapsible, tripod-style support structure that firmly stabilizes the tabletop on both flat and irregular terrain. When the support structure is detached from the tabletop, it can be easily collapsed for transport and storage.

1 Claim, 3 Drawing Sheets

(56) References Cited

U.S. PATENT DOCUMENTS 3,649,423 A * 3/1972 Wilton et al. ..... B44C 1/26 108/161
3,706,435 A * 12/1972 Tedeschi, Jr. ..... A47G 33/12 248/188.7
3,715,038 A * 2/1973 Winkler ..... A47B 31/00 190/18 A
3,745,303 A * 7/1973 Epperson ..... A47J 37/06 108/25
3,851,599 A * 12/1974 Bridges ..... A47B 11/00 108/25
3,875,873 A * 4/1975 Howitt ..... A47B 3/06 108/156
4,092,042 A 5/1978 Cusenbary
4,122,780 A * 10/1978 Brickman ..... A47B 3/02 108/25
4,315,467 A * 2/1982 Vanderminden ..... A47B 3/12 108/157.15
4,341,164 A 7/1982 Johnson
4,448,312 A * 5/1984 Schuman ..... A47G 23/06 108/25
4,609,192 A 9/1986 Bratcher
4,700,915 A * 10/1987 Killian ..... A47B 3/06 108/150
4,807,838 A 2/1989 Anderson
4,940,003 A * 7/1990 Mayhew ..... B60N 3/002 108/25
5,379,975 A 1/1995 Berkowitz
5,460,102 A * 10/1995 Pasmanick ..... A47B 23/002 108/25
5,549,072 A * 8/1996 Maloney ..... A47C 7/004 114/363
5,860,534 A * 1/1999 Minneman ..... A47B 81/005 108/150
6,016,756 A 1/2000 McMahon
6,314,891 B1 11/2001 Larson
6,877,443 B2 4/2005 Rivera
7,913,631 B2 3/2011 Hawkins
8,188,410 B2 5/2012 Dean
8,479,663 B2 7/2013 Davis
8,584,598 B2 11/2013 Derkoski
8,857,346 B2 10/2014 Khanjian
9,220,339 B1 * 12/2015 Chen ..... A63B 47/00
9,259,081 B2 * 2/2016 Rassat ..... A47C 5/04
2006/0196396 A1 * 9/2006 Rivera ..... A47B 13/06 108/157.1
2008/0072802 A1 3/2008 De Oliveira
2011/0012392 A1 1/2011 Herschler
2012/0234212 A1 9/2012 Boirun
2014/0261093 A1 9/2014 Berkowitz

* cited by examiner

COLLAPSIBLE OUTDOOR TABLE

CROSS REFERENCE TO RELATED APPLICATIONS

This application is entitled to the benefit of provisional patent application No. 62/120,575 filed on Feb. 25, 2015, the specification of which is incorporated herein by reference.

BACKGROUND OF THE INVENTION

The present invention relates to a collapsible outdoor table that conveniently secures beverage containers, plates and various personal items.

DESCRIPTION OF THE PRIOR ART

When food and beverages are provided at certain outdoor events, trays or tables are often unavailable. Therefore, disposable plates must be awkwardly supported on one's lap where they are easily overturned, spilling food onto the ground or clothing. A myriad of portable trays and tables exist in the prior art that purportedly address this problem. However, many include deployable support legs that are unstable on uneven terrain, causing the tray to shift and spill food or beverages. Furthermore, because conventional trays typically include a planar support surface, wind can circulate beneath the elevated rim of a disposable plate, and displace it from the tray. Finally, conventional outdoor trays are bulky and only minimally collapsible.

Accordingly, there is currently a need for an outdoor table that is firmly stabilized on uneven terrain and which securely retains lightweight, disposable utensils thereon. The present invention addresses this need by providing a portable table having indented surfaces for securing beverage containers and plates. The table is stabilized on underlying terrain by a collapsible, tripod-style support structure that will not shift or wobble.

SUMMARY OF THE INVENTION

The present invention relates to a collapsible outdoor table comprising a substantially triangular tabletop having a centrally positioned, circular indention on an upper surface for retaining a plate. Surrounding the central indention are a plurality of cylindrical cavities for holding a beverage container and a recessed area for storing accessory items. The tabletop is elevated above underlying terrain by a collapsible, tripod-style support structure that firmly stabilizes the tabletop on both flat and irregular terrain. When the support structure is detached from the tabletop, it can be easily collapsed for transport and storage.

It is therefore an object of the present invention to provide an outdoor table that is configured to securely retain plates and beverage containers.

It is therefore another object of the present invention to provide an outdoor table having uniquely designed support legs for stabilizing the table on uneven surfaces.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
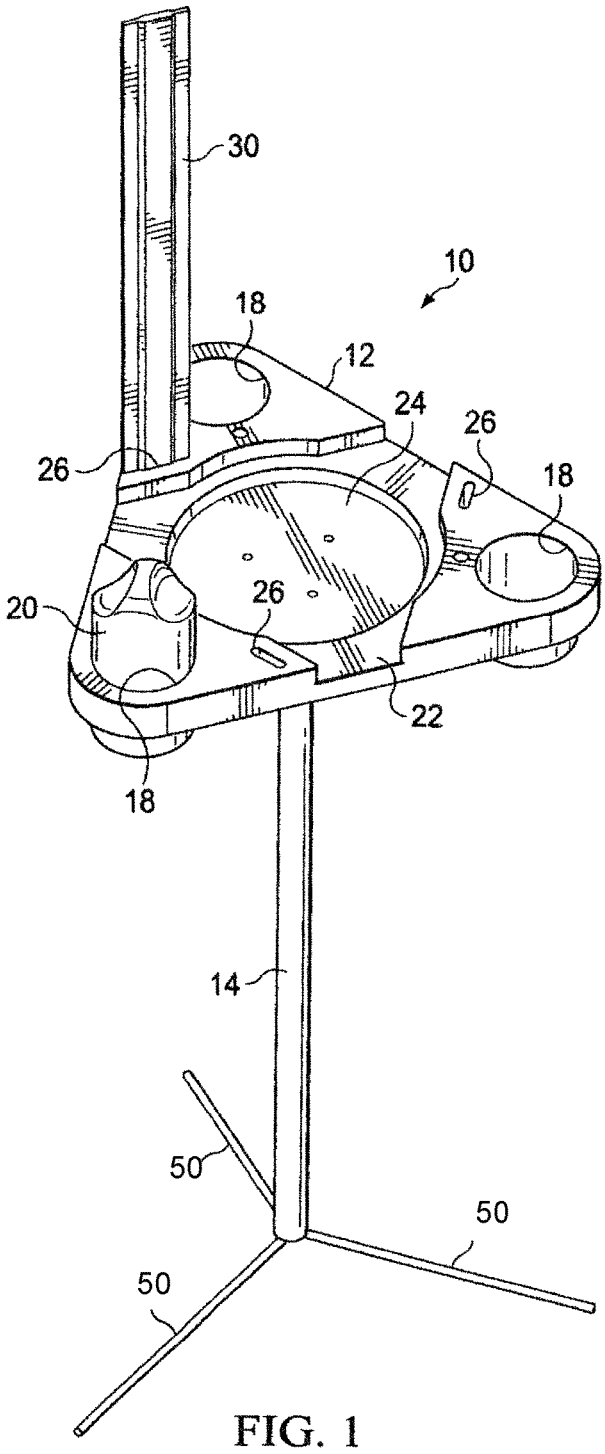
FIG. 1 is a perspective view of the outdoor table according to the present invention.
Figure 6:
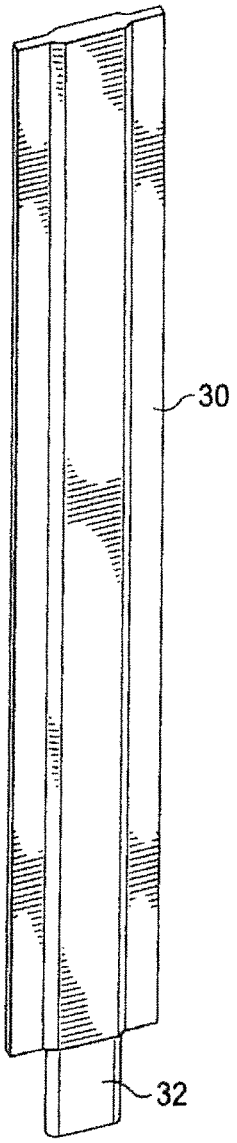
FIG. 6 depicts a blade for supporting accessories on the tabletop.
Figure 2:
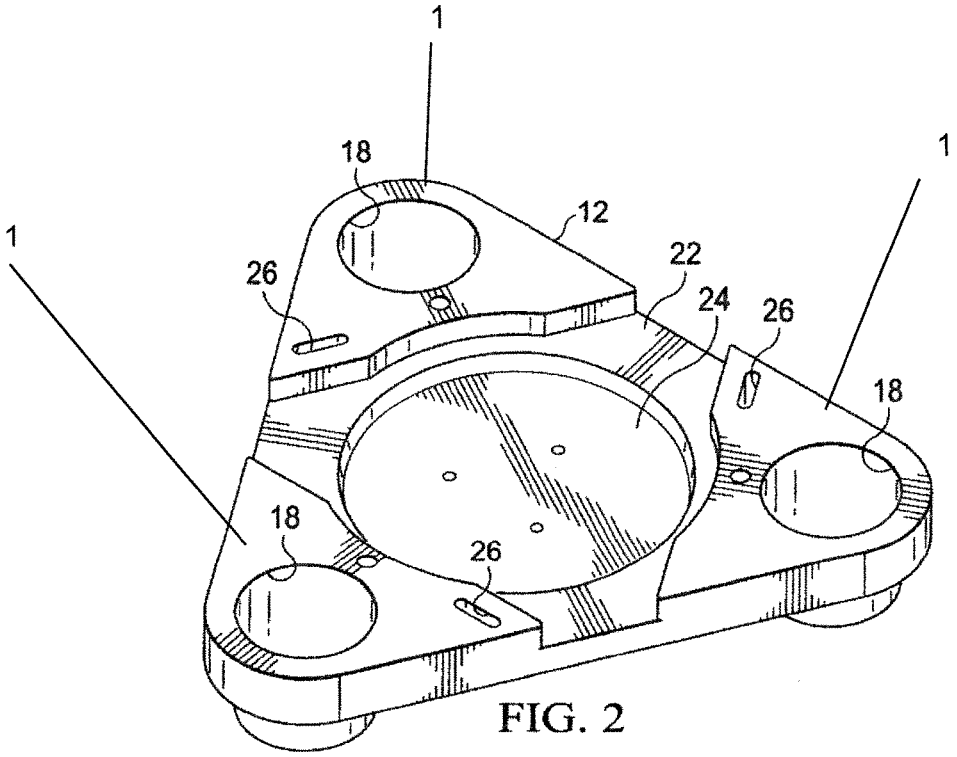
FIG. 2 is a top, perspective view of the tabletop.
Figure 3:
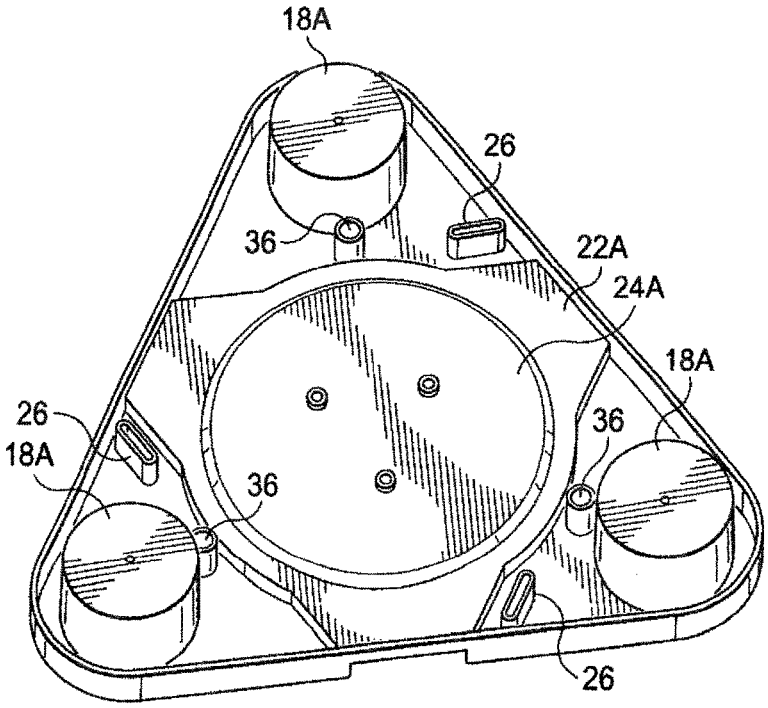
FIG. 3 is a bottom view of the tabletop.

Now referring to FIG. 1, the present invention relates to a collapsible outdoor table, identified generally as 10, that is particularly designed to accommodate an individual diner. The table 10 comprises a substantially triangular tabletop 12 having an upper surface and a lower surface 22A. Centrally positioned on the upper surface is a circular indention 24 that is dimensioned and configured to receive a specific size plate. Therefore, the plate is positioned below the tabletop 12 to prevent wind displacement. Surrounding the central intention are a plurality of raised platforms 1 that form a continuous recessed area 22 around the indention for retaining accessory items, such as keys, game pieces, silverware, etc.

Each platform includes a cup holder formed of a cylindrical cavity 18 that is adapted to retain a beverage container, and possibly an insulated jacket therefor, i.e. a "koozie." A cylindrical cover 20 having a pair of finger indentions 2 at an upper end can be snapped into any of the cavities to prevent debris intrusion or to enclose and protect items such as keys, wireless phones, currency or a wallet. The cover 20 may be secured within the cavities 18 using any number of mechanisms, such as, but not limited to, a gasket that fits within a groove 28.

The portable table further includes an elongated blade 30 having a tab 32 at a lower end that firmly fits within a slot 26 on any one of the platforms to uprightly support the blade on the tabletop 12. The blade is configured to support score cards, graphic elements or any other similar items. The slots 26 can also receive an unlimited number of other accessories as well.

Figure 4:
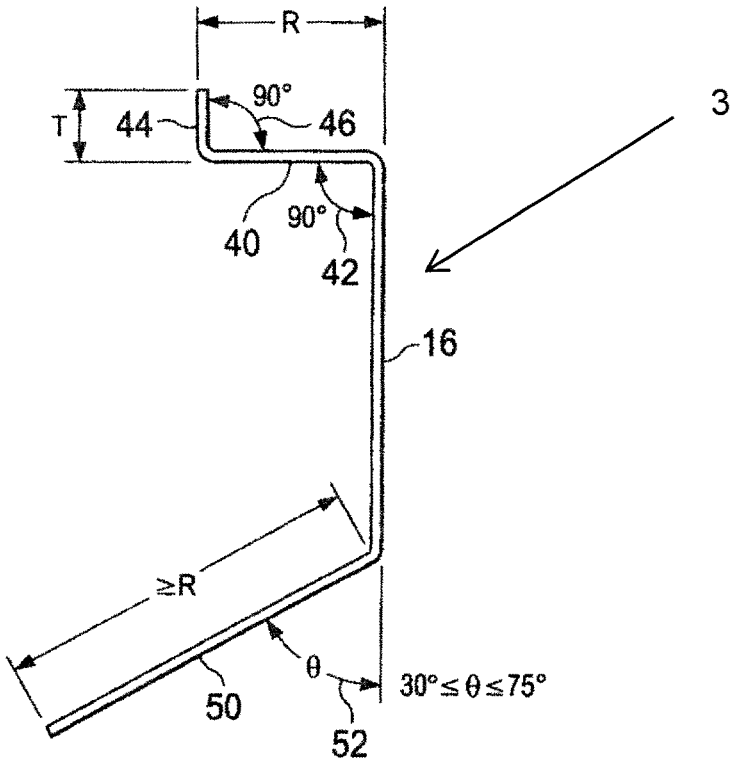
FIG. 4 depicts an exemplary leg member.
Figure 5:
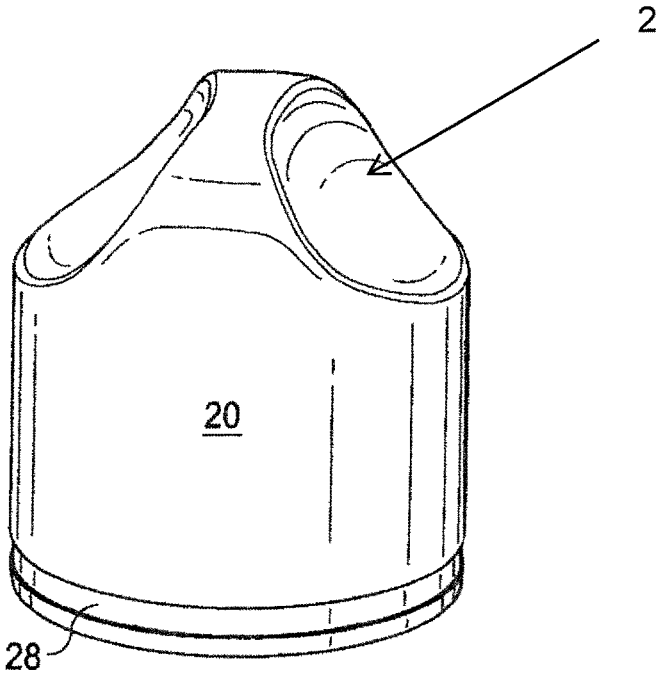
FIG. 5 depicts an exemplary cup-holder cover.

Now referring primarily to FIG. 4, the tabletop is elevated above an underlying surface by a support structure formed of a plurality of leg members 3, each including a vertical intermediate section 16 with an outwardly flared lower section 50 obliquely extending at predetermined angle 52 therefrom. The angle 52 is preferably between 30° and 75° though the angle can be varied. At the top end of each intermediate section is horizontal upper section 40 having a pin 44 vertically extending from a distal end that fits within a designated receptacle 36 on the lower surface of the tabletop. Alternatively, smaller trays, tables or other circular objects may be positioned atop the horizontal upper sections 40 with the pins 44 surrounding and abutting the periphery. The angles 42, 46 between the intermediate section, the upper section and the pin are preferably 90° though the angles can be varied according to a particular application.

The intermediate sections 16 of the legs are rotatably bundled in an elongated sleeve 14 with the lower sections 50 extending outwardly from a bottom end, preferably at equal radial angles, i.e, 120° if three legs are used, or 90° if four are used. The uniquely designed support legs form a tripod-style support structure that firmly stabilizes the tabletop on both flat and irregular terrain. Furthermore, when the leg members are properly secured, the sleeve forms a central pedestal on which the tabletop is balanced. When the support structure is detached from the tabletop, the leg members are easily collapsed against each other to allow the support structure to be placed within an accompanying bag for transport or storage.

The above-described device is not limited to the exact details of construction and enumeration of parts provided herein. For example, although the device has been primarily depicted and described as an outdoor table, the uniquely designed support structure can be used to elevated virtually any other work surface or display device, such as tackle box, a palette or other artist utensils, a flat tabletop, a display table for jewelry or similar items, a keyboard or any other object that is more ergonomically accessible when elevated. As with the tabletop described above, the work surface or display device would include receptacles 36 on a lower surface for receiving the pins 44. Furthermore, the size, shape and materials of construction of the various components can be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A collapsible support structure comprising:

a plurality of leg members, each of said leg members having a vertical intermediate section, said intermediate section having a top end and a bottom end;

an outwardly flared lower section obliquely extending from the bottom end of said intermediate section;

an upper section horizontally extending from the top end of said intermediate section, said upper section having a pin vertically extending from a distal end that fits within a designated receptacle on a lower side of a work surface;

an elongated sleeve rotatably receiving the intermediate section of each said support legs with the lower section of each of said leg members extending outwardly from a bottom end of said sleeve to stabilize the work surface on both flat and irregular terrain when said leg members are attached to said work surface, and which allows said leg members to be collapsed against each other when said leg members are detached from said work surface to facilitate transport and storage.

* * * * *